United States Patent [19]

Giede et al.

[11] Patent Number: 4,761,249

[45] Date of Patent: Aug. 2, 1988

[54] SOIL-COLLECTING CLEANING ENHANCERS IN AQUEOUS SURFACTANT LAUNDERING AND CLEANING SOLUTIONS

[75] Inventors: Karl Giede, Hilden; Brigitte Giesen; Horst Hoeffkes, both of Duesseldorf; Alfred Meffert, Monheim; Andreas Syldatk; Johann F. Fues, both of Duesseldorf, all of Fed. Rep. of Germany

[73] Assignee: Henkel Kommanditgesellschaft auf Aktien, Duesseldorf, Fed. Rep. of Germany

[21] Appl. No.: 945,610

[22] Filed: Dec. 23, 1986

[30] Foreign Application Priority Data

Dec. 23, 1985 [DE] Fed. Rep. of Germany ..... 3545990

[51] Int. Cl.[4] ..... C11D 17/04; C11D 17/06; C11D 3/26

[52] U.S. Cl. ..... 252/528; 252/90; 252/91; 252/179; 252/547

[58] Field of Search ..... 252/90, 91, 547, 528, 252/179; 134/174

[56] References Cited

U.S. PATENT DOCUMENTS

| | | | |
|---|---|---|---|
| 3,472,840 | 10/1969 | Stone et al. | 26/231 |
| 3,589,978 | 6/1971 | Kamal et al. | 162/158 |
| 3,632,559 | 1/1972 | Matter et al. | 260/78 |
| 3,694,364 | 9/1972 | Edwards | 252/90 |
| 3,816,321 | 6/1974 | Kleinschmidt | 252/134 |
| 3,864,317 | 2/1975 | Ogata et al. | 260/79.3 M |
| 3,910,862 | 10/1975 | Barabas et al. | 260/79 |
| 3,952,128 | 4/1976 | Ogata et al. | 428/265 |
| 4,066,394 | 1/1978 | Leonard | 8/137 |
| 4,132,680 | 4/1978 | Nicol | 252/547 |
| 4,148,603 | 4/1979 | Schwuger | 8/137 |
| 4,157,388 | 6/1979 | Christiansen | 424/70 |
| 4,230,590 | 10/1980 | Wixon | 252/97 |
| 4,240,450 | 12/1980 | Grollier et al. | 132/7 |
| 4,272,515 | 6/1981 | Hofman et al. | 424/70 |
| 4,292,212 | 9/1981 | Melby | 252/547 |
| 4,380,453 | 4/1983 | Claiborne | 8/606 |
| 4,557,854 | 12/1985 | Plueddemann | 252/174.15 |
| 4,576,744 | 3/1986 | Edwards et al. | 252/554 |

FOREIGN PATENT DOCUMENTS

| | | |
|---|---|---|
| 0153146 | 2/1985 | European Pat. Off. . |
| 1136842 | 3/1966 | United Kingdom . |

OTHER PUBLICATIONS

Chemical Abstracts, 93:116353A.

*Primary Examiner*—Paul Lieberman
*Assistant Examiner*—Kathleen Markowski
*Attorney, Agent, or Firm*—Ernest G. Szoke; Henry E. Millson, Jr.; Real J. Grandmaison

[57] ABSTRACT

Soil-collecting detergency enhancers for detergent solutions comprising a substantially water-insoluble polyfunctional quaternary ammonium compound or a water-soluble polyfunctional quaternary ammonium compound fixed to a water-insoluble solid carrier. The detergency enhancers may be used in the cleaning of soiled articles, particularly those soiled with pigments, in aqueous detergent solutions such as for washing fabrics.

20 Claims, No Drawings

SOIL-COLLECTING CLEANING ENHANCERS IN AQUEOUS SURFACTANT LAUNDERING AND CLEANING SOLUTIONS

BACKGROUND OF THE INVENTION

1. Field of the Invention

This invention pertains to new methods and processes which can be used in the cleaning of articles, especially those soiled with pigment soil, and in particular, the washing or cleaning of all types of articles in aqueous-surfactant baths. Textile laundering is probably the most important application area of such cleaning methods.

2. Statement of Related Art

The laundering process of textiles using conventional laundering agents is known to involve the breaking up and loosening of the soil on or from the fiber. Considerable fractions of the soil represent components which are insoluble in the wash bath, and which pass over into the wash bath in the form of small undissolved particles. Adequate suspension of the loosened soil particles is then a prerequisite for effective laundering, in order to prevent their redeposition and simultaneous graying of the washed material. Conventional detergents contain additives which especially serve this purpose. However, adequate soil suspending ability is also regarded as an important function of the builder constituents of conventional laundry detergent formulations, which are known to contain synthetic surfactant components in admixture with such builder components.

It is also known that in modern laundry detergents with a reduced content of phosphate builders, the synthetic crystalline zeolites used as phosphate substitutes, and especially the corresponding very finely-divided insoluble zeolite NaA of detergent grade counteract redeposition and combat graying because of the large solid surface area which they make available.

The laundry detergent literature contains numerous suggestions for reducing the graying tendency and thus improving the secondary washing power. All these suggestions are aimed almost exclusively at improved suspension, solubilization and stabilization of the particulate soil in the wash bath, even and precisely in the rinse-out cycles of the washing process, in which the tendency for redeposition of dissolved particulate soil is increased by dilution of the laundry chemicals. A fundamentally different approach is described in U.S. Pat. No. 3,694,364. It is therein suggested that a so-called "dirt trap" material should be used to take up and undissolved particulate soil from the wash bath, possibly together with the prevention of anionic coloring material transfer. This dirt trap material consists of a water-insoluble cellulose cloth with a modified surface. This surface is provided with secondary and/or tertiary polyamine compounds which are to be retained on this surface in that the cellulose surface is initially given an anionic character. This is accomplished by the introduction of acid groups, for example via phosphorylation, carboxymethylation and the like. For subsequent coating with polymeric amines, polyethylene amines are considered especially suitable which have a degree of polymerization of 2–50,000, especially 20–20,000 monomer units per molecule, and in which about 10–50% of the amino groups are occupied with stearic acid residues. Cloths provided with such a finish are introduced into the laundry process together with conventional textile detergents. In this way soil is to be deposited from the wash bath onto the cloth surface. These soil components can be separated from the washed material after laundering and thrown away with the dirt trap cloth. To be sure, the document taken under consideration describes the production and nature of the surface-finished, flat cellulose substrate structure. However, no detailed information is given on the laundering results achievable with it.

The concept of reducing anionic dye transfer in textile laundering, caused by bleeding of anionic dyes not adequately fixed on the fiber, by simultaneously using polycationic auxiliaries which bind anionic dye fractions dissolved in the wash bath also appears in the relevant literature in another connection. Thus, European Pat. No. 0,044,003 describes a liquid detergent which consists of selected nonionic surfactants in admixture with textile-softening quaternary ammonium salts, to which an ammonium group-containing cationic starch ether has been added. In laundry experiments without soil loading and under process conditions which were not more closely specified, increased reflectance values were obtained on white cotton cheesecloth washed along with it, when material pieces dyed with colors that bleed are washed with the new laundry detergent. The loading of the wash bath with undissolved particulate soil and the problems deriving from this are not discussed. The same is true from the teaching of European Pat. No. 0,033,815, wherein, in order to prevent dye transfer to the bath, an agent is added which contains a cellulose carrier material with an application of especially glycidyltrimethylammonium chloride or the corresponding halogenated compound. These superficial detergent auxiliaries are intended to control the undesirable transfer of any dyes present in a liquid wash bath. It is mentioned that reuse of these auxiliaries for the indicated purpose is possible. The pigment soil problem from ordinary textile laundering in surfactant wash baths or in other cleaning processes is not mentioned.

DESCRIPTION OF THE INVENTION

Other than in the operating examples, or where otherwise indicated, all numbers expressing quantities of ingredients or reaction conditions used herein are to be understood as modified in all instances by the term "about".

An object of the present invention is to provide improvements in the washing of, for example, fabrics in particular with aqueous detergent liquors which, hitherto, have been unobtainable in this form. The technical solution in accordance with the invention plans the use or accompanying use in the cleaning process, thus especially in textile laundering as well, of components which are systematically suitable for the retention of undissolved soil particles taken up into the wash bath, and thus in particular for collecting pigmented soil in the wash bath during the laundering process, without exerting a negative effect on the laundering process itself. The use of these soil collectors should take place in such a physical form that after completion of the cleaning or laundering process, the manual and/or mechanical removal of the now soil-loaded auxiliaries from the washed material is possible. Thus, in essence, the invention is aimed at transferring the soil from the material to be cleaned to auxiliaries simultaneously introduced into the cleaning process, which subsequently can be separated, along with the soil constituents which they have collected, from the cleaned articles and discarded, or if their capacity for soil loading is not yet fully utilized, can be once again returned to a laundering process. More specifically, the present invention relates to the use of polyfunctional quaternary ammonium compounds, herein after referred to in brief as "PQUATS" which are at least substantially insoluble in aqueous detergent solutions and/or are immobilized on or fixed to solids correspondingly insoluble in such aqueous solutions as soil-collecting detergency enhancers in aqueous detergent solutions which may be manually and/or mechanically removed from the fabrics to be cleaned after the washing process.

In a further embodiment, the invention relates to textile detergents based on customary mixtures of surfactants, corresponding builders, and if desired additional ordinary laundering auxiliaries such as bleaching agents, corrosion inhibitors, optical brighteners, antifoaming agents, graying inhibitors, enzymes, diluents, perfumes and the like, wherein these textile detergents are characterized in that for collecting particulate soil from the wash bath they additionally contain PQUATs in finely divided and/or sheet form, which are insoluble in aqueous-surfactant laundering and cleaning baths even under the temperature stresses of the laundering process and/or are immobilized on solids appropriately insoluble in these aqueous surfactant baths in such a way that they cannot be washed off. These insoluble, finely divided and/or superficial PQUATs serve as particulate soil accumulating cleaning enhancers in accordance with the invention, wherein they can be manually and/or mechanically removed from the material to be cleaned after laundering or cleaning.

Finally, in a further embodiment the invention pertains to a process for enhancing the cleaning of aqueous-surfactant laundry and cleaning baths by simultaneously using in the laundering process undissolved solids in sheet form and/or introduced into the wash baths in finely divided form, capable of binding suspended particulate soil from the aqueous surfactant baths on their surface and retaining it there until the end of the laundering process, and can be manually and/or mechanically separated in this form from the goods to be cleaned. The new process is characterized in that the cleaning-enhancing solids used are PQUATs which are also insoluble in the aqueous surfactant baths under the temperature conditions of the laundering process, and/or are bound in immobilized form to solids appropriately insoluble in these baths in such a manner that they cannot be washed off.

Polyfunctional quaternary ammonium compounds (PQUATs) are described and known in the documented state of the art, and are also commercially available in many forms. One important area of application for such compounds is in the area of cosmetic preparations, especially for treating or conditioning the hair. One of the known characteristics of PQUATs is that they are capable of being absorbed on solid surfaces, in particular even in the presence of standard surfactant components. The ability of PQUATs to be absorbed and to remain absorbed on solid surfaces differs according to their composition. The particular composition of the PQUATs plays a crucial role in this regard. However, for the behavior of the PQUATs under the influence of aqueous surfactant baths, the interaction especially with anionic surfactant components may be of determining significance here. In the case of stoichiometric or approximately stoichiometric amounts of the anionic surfactant components, the corresponding anionic surfactant salt usually forms on the quaternary ammonium group. Such PQUAT-anionic surfactant salts generally show a greatly reduced water solubility. Appropriate precipitates form, see for example German Preliminary Published Application No. 2,242,914. Such anionic surfactant salts of PQUATs have been suggested as antistatic agents for application to fibers. However, it is also known in this regard that as a result of considerable excessive amounts of the anionic surfactant, a redissolution of the initially precipitated PQUAT-anionic surfactant salt can occur, see in this regard the publication in Seifen-Öle-fette-Wachse, pp. 529 to 532 and 612 to 614, 1965. Especially in the reaction diagram on p. 530 of this citation, the formation of solubilized micelle systems of the anionic surfactant/PQUAT complex in the presence of an excess of the anionic surfactant is shown. To be sure, such soluble PQUAT-micelle complexes, especially in the case of dilution with water, still have a certain uptake capacity especially on fibrous materials, but very firmly adhering bonds are not achieved. In particular application, the hair cosmetic field makes use of this; to produce hair conditioners that can be washed out, this field making use of the relationship between soluble and insoluble forms of the PQUAT reaction products with anionic surfactants and the retained substantivity of such components.

In general, these previously known PQUATs are oligomers and/or polymers which have a majority or plurality of quaternary ammonium groups on their oligomeric or polymeric matrix. In general, adequate water solubility of a PQUAT is required for use in cosmetics. By contrast, the use of PQUATs in accordance with this invention presupposes the insolubility of the PQUAT-based detergency enhancers used as soil collectors in aqueous-surfactant laundry or cleaning solutions. The insolubility of the PQUAT components used as soil collectors in accordance with this invention is actually an absolute prerequisite especially for the area of textile laundering. If this critical condition in accordance with the invention is not met, the desired laundering result is adversely affected. Soluble PQUAT fractions entering the wash bath are attracted to the textile material to be washed, and bind additional pigment soil quantities thereto. The laundering result is then changed to exactly the opposite of that desired. At least a spotty, and sometimes even heavily superficially grayed textile is then obtained as a result of the laundering process.

Nevertheless, in an important embodiment of the invention, it is possible to use all previously known originally water soluble PQUAT components for the application in accordance with this invention. For this purpose it is only necessary to convert the inherently water-soluble and/or water-swellable PQUAT components of the prior art into the desired insoluble form, or to fix them on appropriate water-insoluble carriers and immobilize them in such a way that they cannot be washed off from the carrier during the cleaning process. As will be described hereinafter in detail, various possibilities are available for this purpose.

It is immediately understandable that this condition of insolubility can be fulfilled both by the PQUATs used as cleaning enhancers and by the possibly simultaneously used carrier under the anticipated load of the laundering process and especially the corresponding thermal loading. In this manner, however, it also becomes apparent that polycationic starch ethers, as disclosed in the aforecited European Pat. No. 0 044 003 at best might be used in accordance with this invention under very specific selected conditions which are not therein disclosed. Starches and starch ethers tend to become pasty in the aqueous phase even at moderate temperatures. Chemically, this entails transfer of part of the originally crystalline starch into the dissolved phase. The result of this paste formation, even if it only occurs at certain locations, is the formation of spots on the materials being washed.

The teaching of this invention is based on recognition of this state of affairs. However, general chemical knowledge makes it possible also for the purposes in accordance with the invention to use all polyfunctional quaternary ammonium compounds known from the state of the art, especially those of oligomeric and/or polymeric type, which originally exist in soluble form or show a tendency to dissolve, especially in the presence of an excess of anionic surfactants, with PQUAT/-micelle formation.

Suitable polyfunctional quaternary ammonium compounds that may be employed in this invention include those mentioned, for example, in U.S. Pat. Nos. 3,589,978, 3,632,559, 3,910,862, 4,157,388, 4,240,450 and 4,292,212; Great Britain Pat. No. 1,136,842; German Published Application No. 27 27 255 and U.S. Pat. No. 3,472,840 cited therein. More specifically, Great Britain Pat. No. 1,136,842 discloses quaternary ammonium galactomannan derivatives and their use in the formation of paper. The derivatives are quaternary ammonium galactomannan gum ethers wherein at least one hydroxyl group has been reacted with a quaternary ammonium compound such as 2,3-epoxy-propyl trimethylammonium chloride or 3-chloro-2-hydroxypropyl trimethylammonium chloride.

U.S. Pat. No. 3,472,840 relates to quaternarynitrogen containing cellulose ethers having a backbone of anhydroglucose units with pendant substituent groups bearing a full positive charge spaced along the backbone.

U.S. Pat. No. 4,157,388 is directed to polycationic or polyquaternary ammonium lonenes useful as conditioning agents for hair and textiles.

U.S. Pat. No. 3,632,559 teaches cationically active, water soluble polyamides obtained by alkylation with a bifunctional alkylation agent until the alkylation agent is used up, of a reaction product resulting from the reaction of a dicarboxylic acid or a functional derivative thereof with a polyalkyenepolyamine.

U.S. Pat. No. 4,240,450 relates to compositions for the treatment of keratin material, in particular human hair, comprising a combination of a cationic polymer with an anionic polymer. The anionic polymer contains at least one of a sulfonic acid, carboxylic acid, and phosphoric acid unit, and has a molecular weight of from about 500 to 5 million. The cationic polymer may contain primary, secondary, tertiary or quaterary amino units and have a molecular weight of 500 to 2 million.

U.S. Pat. No. 3,589,978 discloses quaternary ammonium polygalactomamman gum ethers which are prepared by reacting the gums with reactive quaternary ammonium compounds. The starting polygalactomannan gums may be guar gum and locust bean gum.

The starting quaternary ammonium compounds particularly suitable may be defined by the following formula:

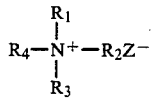

Where $R_1$, $R_2$ and $R_3$ are selected from the group consisting of alkyl, substituted alkyl, alkene, aryl and substituted aryl groups, $Z^-$ is an anion and $R_4$ is selected from the group consisting of epoxyalkyl and halohydrin groups. Illustrative of anion $Z^-$ are $CL^-$, $Br^-$, $I^-$ and $HSO_4^-$.

U.S. Pat. No. 3,910,862 is directed to copolymers of vinyl pyrrolidone containing quaternary ammonium groups. The copolymers are prepared by heating a solution comprising vinyl pyrrolidone and a dilower alkylaminoalkyl acrylate or methacrylate in a solvent therefor in the presence of a free radical initiator at temperatures ranging from about 30° C. to about 100° C. for a sufficient period of time to substantially effect copolymerization, and thereafter admixing the copolymer with a quaternizing agent to quaternize the resulting copolymer.

U.S. Pat. No. 4,292,212 teaches a cationic derivative of a 3-trimethylamino-2 hydroxypropyl guar chloride salt. This material contains as the basic unit two mannose units with a glycosidic linkage and a galactose unit attached to one of the hydroxyls of the mannose units. On average, each of the sugar units has three available hydroxyl sites. The hydroxyl groups of the guar are reacted with certain reactive quaternary ammonium compounds to produce the cationic polymers. The quaternary ammonium compounds are commercially available as Cosmedia® c-261 cationic guar.

Suitable originally water-soluble or water-insoluble PQUATs in accordance with this invention preferably have an average molecular weight of at least about 200, preferably at least about 300 and more preferably of at least 1000. The upper limit of the average molecular weight of the PQUATs is basically meaningless and may be, for example, up to 10 million or at even far higher values. This is clear from the water insolubility requirement which the PQUATs have to satisfy in accordance with the invention. If this is assured, no upper limits are set on the molecular weight.

After suitable preparation, for the purposes of the invention, which will be described in more detail hereinafter, suitable PQUATs, initially water soluble but subsequently immobilized on an insoluble carrier, include all polymers which have quaternary ammonium groups either in the polymer chain or attached to the polymer chain. Such quaternary ammonium groups can also be derived from cyclically bonded nitrogen. Examples of such quaternary ammonium grous include corresponding members of 5- or 6-membered ring systems, e.g., morpholine, piperidine, piperazine or indazole rings. Numerous examples of such water-soluble PQUATs are described in greater detail, for example, in U.S. Pat. No. 4,240,450.

Homopolymers or copolymers containing cyclic units of the type described in U.S. Pat. No. 3,912,808 are particularly suitable herein. For example, the homopolymer of dimethyldiallylammonium chloride sold under the tradename Merquat® 100, and the copolymer of dimethyldiallylammonium chloride and acrylamide sold under the tradename Merquat® 550 (Quaternium 41) have this structure.

Other particularly suitable PQUATs include, for example, cellulose ethers wherein the anhydroglucose units each contain from 1 to 3 substituents containing quaternary ammonium groups attached via ether oxygen. Polymers such as these are known, for example, from U.S. Pat. No. 3,472,840. A commercial product having this structure is, for example, Polymer-JR® 400.

Other particularly suitable cationic polymers include, for example, the quaternary polyvinylpyrrolldone copolymers disclosed in U.S. Pat. No. 3,910,862 and commercially available, for example, under the tradename Gafquat® 734 and 755, and the quaternary polymeric urea derivatives disclosed in U.S. Pat. No. 4,157,388, and available, for example, under the tradename Mirapol® A 15. Other suitable copolymers with polycationic characteristics include the polyacrylamide copolymers described in European Patent Application No. 0,153,146, laid open for public inspection, which in particular in addition to 50 mol-% acrylamide units contain up to 50 mol-% of a quaternized aminoalkyl ester of acrylic acid or methacrylic acid. These copolymers are water-soluble. They are applied therein to cloths based on cellulose fibers and become attached thereto on the basis of their natural attractive capacity. Cloths of this type can be washed out and are then to be used, together with anionic surfactant-free surfactant systems, for cleaning hard surfaces, especially for glass cleaning. Under these conditions they are characterized by an increased soil untake capacity. However, the cleaning cloths mentioned in the document are suitable for the use in customary surfactant laundry and detergent baths intended in accordance with this invention, which may also be exposed to temperature loads of up to about 95° C. Considerable portions of the numerous PQUAT copolymers described in the document are released into the wash bath, are attracted to the material to be cleaned, and lead to increased pigment contamination there. Only the conversion of such PQUATs into the physical state that will be mentioned below in accordance with this invention can convert them to cleaning enhancers in accordance with this invention.

Preferred PQUATs in accordance with this invention are those compounds which, in solid form, are difficult to dissolve in water. Cationic polymers such as these are, more preferably, the polygalactomannan derivatives known, for example, from Great Britain Pat. No. 1,136,842. Galactomannans are polysaccharides which occur in the endosperm cells of many leguminosae seeds, but that are only obtained on an industrial scale from locust bean gum, guar gum and tara gum. They are made up of a linear mannan main chain, consisting of mannopyranose building blocks which are attached by B-(1,4)-glycoside bonds and to which individual galactopyranose residues are fixed as branches by -(1,6)-glycoside bonds. The individual polygalactomannans differ from one another primarily in their mannose-galactose ratio. The cationic derivatives of the polygalactomannas are prepared by reacting hydroxyl groups of the polysaccharide with reactive quaternary ammonium compounds. Suitable reactive quaternary ammonium compounds include, for example, those of the following general formula:

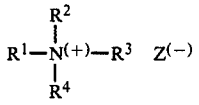

wherein $R^1$, $R^2$ and $R^3$ represent, for example, methyl or ethyl groups, and $R^4$ represents an epoxyalkyl group corresponding to the formula

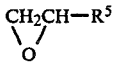

or a halohydrin group of the formula

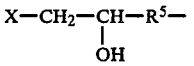

wherein $R^5$ is an alkylene group with 1–3 carbon atoms, X is chlorine or bromine, and Z is an anion, such as, for example chloride, bromide, iodide or hydrogen sulfate. The degree of substitution should be at least about 0.01 and preferably at least about 0.05, and typically falls between about 0.05 and about 0.5. A particularly suitable quaternary ammonium derivative of a polygalactomannan is, for example, guarhydroxypropyltrimethylammoniumchloride, which contains cationic groups of the formula $$-CH_2-CH(OH)-CH_2N^{(+)}(CH_3)_3Cl^{(-)}$$

bonded to the oxygen atoms of the hydroxyl groups of the polysaccharide. Such cationic guar derivatives are marketed, for example, under the tradename of "Cosmedia Guar C 261". The degree of substitution (DS) of Cosmedia Guar C 261 is about 0.07. The commercial products "Jaguar C-13" (DS=0.11–0.13) and "Jaguar C 13 S" (DS=0.13) also belong to this type.

In the following will be described the manner in which cleaning-enhancing and particulate soil-collecting auxiliaries in accordance with this invention are produced from all of these or from other comparable, inherently swellable PQUAT starting materials.

Basically, the soil-collecting detergency enhancer used in accordance with this invention may be used in any physical form which enables the detergency enhancer to be charged with soil particles and then manually and/or mechanically removed in undissolved form from the washed fabrics. The PQUATs of the correspondingly PQUAT impregnated insoluble solid materials may be used in particular in two physical forms, namely in the form of sheet-form materials, particularly sheets, films or cloths, and on the other hand in the form of a finely divided solid material which may be dispersed, for example, in the wash liquor during the washing process, but which may be removed with the wash liquor on completion of washing and thus separated from the washed fabrics. The invention is described hereinafter with particular reference to these two embodiments which relate to the joint use of the PQUATs during washing in the wash liquor charged for example with fabrics, although the invention is by no means confined to these two embodiments. The PQUATs may also be used in other forms within the scope of the invention. For example, a wash liquor may be pump-recirculated through a fixed bed of PQUATs and the wash liquor thus treated returned to the washing process.

For washing fabrics, particularly by machine, for example in domestic washing machines, the new detergency enhancers according to the invention may be used in two specific forms, as described in detail hereinafter. On the one hand, the detergency enhancers according to the invention may be incorporated, preferably in the form of fine powders, in typical fabric detergents, more especially heavy-duty detergents; on the other hand, they may be separately added to the wash liquor, i.e. separately from the introduction of the washing powder from dispensers in the machine.

In the latter case, the new soil-collecting detergency enhancers may be made up both as fine and relatively coarse solid particles and, in particular, as a sheet-form material, for example as a sheet, film or cloth. For example, the new detergency enhancers may be manufactured and used as a sheet-form material in roll form, in which case a predetermined quantity of the sheet-form material is taken from the roll for each wash and introduced with the wash into the washing machine.

On completion of the washing process, the soil collector should be manually and/or mechanically removable without difficulty from the wash. When the collector is present as a sheet-form material, its insolubility guarantees ready separation during unloading of the washed fabrics. Where the detergency enhancer is used in the form of a generally finely particulate material, it may be separated in various ways according to the size of the particles. Where the detergency enhancer is introduced into the wash liquor as an extremely finely divided and insoluble material, it may be removed in the usual way with the wash liquor together with other insoluble very finely divided components of the detergent mixture, for example insoluble zeolite-based builder components, and rinsed out. However, if the detergency enhancer is used in the form of fairly coarse particles, it may be manually removed for example by shaking out the washed fabrics.

Sheet-form embodiments of the new soil collector may be made by methods known per se as nonwovens, woven or knitted cloths, as a preferably open-cell foam sheet, as a closed film or in any other form. The only requirement is that the surface over which the wash liquor flows should contain the PQUATs in a sufficient quantity to contact and collect the soil particles.

For all embodiments of the new detergency enhancer according to the invention, the PQUATs used should be substantially insoluble in water or insoluble in the wash liquor to such an extent that the surface of the detergency enhancer in whatever form it is used can become charged with soil particles and retain them until the washing process is over. Insoluble PQUATs of this type may be obtained by various methods. For example, it is known that water-soluble PQUATs can be crosslinked by reaction with at least bifunctional crosslinking agents to such an extent that they become sufficiently insoluble in water for the purposes of the invention. The selection of a suitable crosslinking agent in each case is determined by the structure of the compounds to be crosslinked taking into consideration knowledge of the general chemical subject matter.

A basically different approach, but one which ultimately produces the same result, comprises subsequently applying quaternary ammonium groups to the surface of preferably already formed, insoluble carrier compounds. Thus, for example, in accordance with known methods, the surface of insoluble or insolublized, formed natural materials and/or corresponding synthesis products can be supplied with quaternary ammonium groups by chemical reaction. Process steps for this purpose are similar to those known in principle from the initially cited literature for the production of water-soluble and/or water-swellable PQUATs. By way of example, this may be illustrated as follows wherein a sheet-form structure such as a nonwoven or a woven or knitted cloth based on natural fibers and/or synthetic fibers may be converted into the desired soil-collecting detergency enhancer by reaction with a coupling component, for example epichlorohydrin, and subsequent reaction with basic nitrogen compound, followed by quaternization, to the desired soil-collecting laundering power enhancer. The same also applies to granular or powder-form material made from natural and/or synthetic water-insoluble starting materials. Other suitable reactive quaternization agents are the quaternary ammonium compounds described in conection with the previously mentioned British Pat. No. 1,136,842, having a reactive epoxy group, or their reaction products with hydrogen halides to form the corresponding halohydrin group.

Especially readily accessible and economical starting materials for such a reactive surface modification, insoluble in laundering and cleaning baths of the type mentioned, are natural substances such as cellulose, insoluble cellulose derivatives, and other insoluble or insolubilized polysaccharide-like natural materials or their derivatives. The introduction of quaternary ammonium group-containing residues proceeds without problems here since the polysaccharide components used as carriers are either initially insoluble, for example, in the case of cellulose, or can be readily converted to the insoluble state by simple chemical reactions, for example with polyfunctional cross-linking agents. A decisive factor in the teaching of this invention is that is completely sufficient for the suitability of the cleaning enhancers if the quaternary cationic groups are located on the surface of the formed cleaning enhancer, even though the existence of corresponding groups in deeper material layers is not eliminated. Precisely for reasons of accessibility and price, particular importance is attributed to such especially easy and economical to manufacture cleaning enhancers.

This viewpoint can even be influenced by the selection of the forming method. A granulate or powdered solid material selected on the basis of natural materials is usually easier and thus less expensive to obtain than a sheet structure, for example in the sense of woven or knitted cloth. For practical use in the laundering process as well, the employment of such granular or powdered cleaning enhancers with insolubly finished polycationic surfaces can have a special significance. As was previously demonstrated in connection with the teaching of British Pat. No. 1,136,842, even very low average degrees of substitution in the surface of the natural material or natural material derivative lead to effective results in the process in accordance with the invention. Thus it has proven completely adequate, for example, for the use of formed quaternized polysaccharides or polysaccharide derivatives, to work with average degrees of substitution not exceeding 0.5, and especially not exceeding about 0.35. For the cleaning enhancement within the framework of textile launderings, it is particularly advantageous to utilize an average degree of substitution of up to about 0.12 and preferably below 0.1. In general, the average degree of substitution in the range of about 0.01 will be regarded as the lower limit, wherein particularly good results can be obtained in the range of from about 0.015 to 0.08 and especially from about 0.02 to 0.07. It is surprising that fine cellulose powders of such low degrees of substitution cause a substantial enhancement of the laundering power, especially in textile laundering. The concept of laundering power enhancement thus covers the concept of the so-called primary laundering power enhancement as well as the so-called secondary laundering power enhancement. The improvement of the secondary laundering power enhancement, i.e., reduction of the graying tendencies, is still understandable from the concept of the procedures in accordance with the invention. Surprisingly, however, when suitable cleaning enhancers in accordance with this invention are selected, distinct laundering power enhancement of the primary detergency are also obtained, which can be measured as numerically detectable improvements in the degree of brightening within the framework of a textile laundering process on pigment-soiled test materials. Details in this regard will be found in the following examples which illustrate the invention.

Particular practical significance may be attributed to those embodiments in which PQUATS are immobilized, preferably in a thin layer, on the surface of a water-insoluble sheet-form or granular carrier by physical or chemical fixing in such a way that they are unable to escape into the wash liquor to any significant extent, if at all, during the washing process.

It has been found that, by suitably selecting and adapting the structure and composition of the water-insoluble carrier and the PQUAT, it is also possible to exert an influence on the fixation for adequate adhesive strength of the PQUATs on the supporting surface. If, for example, cotton material, and especially unfinished cotton material is used, and this material is coated with water-soluble and/or at least water-swellable PQUATs as defined in the aforementioned literature on cosmetic PQUAT preparations, a soil-collecting detergency enhancer can be obtained which withstands the usual conditions of the laundering process in a textile washing machine, fulfilling its function as a soil collector, and which can be separated from the washed textile material after the laundering process. However, apparently only PQUAT fractions of higher molecular weight are well fixed with additional action of anionic surfactants. In the normal case with this embodiment it is necessary to anticipate disturbances by bleeding-out PQUAT fractions.

It may therefore be desirable to provide a stronger, namely reactive bonding of the PQUAT coating mass to the insoluble carrier. Here, in a known manner, once again a chemical bonding by means of bifunctional coupling components can come into consideration. However, the following method is also of importance for an embodiment in accordance with the invention, i.e., the fixing of a polymeric PQUAT coating on a shaped base article can be provided wherein anionic groups are formed or exist in or on the surface of the base body. Examples of such anionic groups are carboxyl groups, which can be introduced for example by carboxymethylation into the surface of the base body, or other acid groups such as sulfonic acid groups. More detailed statements may be found in the aforementioned U.S. Pat. No. 3,694,364. The cationic PQUAT coating thus attaches itself firmly in the manner of a salt to these counter-ions of the matrix, so that in this manner the solidified bond between insoluble solid and applied PQUAT layer is created. Merely as an example for this embodiment, a carrier based on cellulose fibers may be mentioned, wherein free carboxyl groups have been introduced into the cellulose molecule. This is possible, for example, in two different ways:

by physical incorporation of compounds containing carboxyl groups in the viscose, i.e. in a cellulose dissolved as cellulose xanthogenate, to form so-called incorporated cellulose fibers; or by chemical reaction such as etherification of the fiber-forming cellulose of the reagents containing carboxyl groups to form cellulose fibers modified throughout by, for example, carboxylalkyl groups corresponding to the following formuls $$-(CH_2)_n-COOH,$$

wherein n may have a value of from 1 to 3.

The physical incorporation of compounds containing carboxyl groups in the viscose may be obtained, for example, by the addition of alkali metal salts of acrylic acid homopolymers, acrylic acid/methacrylic acid copolymers, alginic acid or carboxymethyl cellulose, to the viscose solution and subsequent spinning into a precipitation bath in the usual way. Products based on cellulose fibers such as these and on fibers modified by carboxymethyl groups are commercially available for numerous applications. In the present embodiment, such fibers or carrier materials prepared therefrom may be coated with a PQUAT layer and hence permanently attached thereto for the application under consideration.

A particularly simple insoluble bonding between an inherently inert carrier and an applied insoluble PQUAT layer can be accomplished by the so-called encapsulation principle. If for example an inert insoluble carrier in fine granular form is enveloped with a PQUAT layer, preferably in such a manner as to cover the surface, and this PQUAT layer is then modified to the required state of insolubility under laundering conditions, in this case as well the inseparable combination between the inert support core and the enveloping PQUAT layer is brought about, even if no particular bonding forces exist between these two materials. The conversion of the PQUAT layer to the insoluble material can take place, for example, once again via the chemical route by cross-linking this surrounding material layer. Understandably, the use of this encapsulation principle is not limited to granular detergency enhancers.

However, it is not only water-insoluble organic materials which are suitable as carriers for the soil-collecting PQUAT layer. Particular significance is also attributed to inorganic carriers. In this embodiment, particularly suitable water-insoluble inorganic carriers are those of the type which have already been used in washing processes and particularly in fabric washing processes. Typical examples of inorganic carriers of this type are natural or synthetic, finely divided aluminosilicates of the bentonite or synthetic crystalline zeolite type, more especially, detergent-quality zeolite A which is widely used as a phosphate substitute, zeolite X and zeolite P. Other examples of suitable carrier materials include silica, particularly colloidal silica of the Aerosil ® type, finely divided, swellable or even non-swellable layer silicates, particularly of the montmorillonite type, water-insoluble finely divided metal oxides and/or hydroxides and corresponding metal salts. Alkali metal salts, such as calcium carbonate, calcium sulfate and the like, or aluminum oxide and the like are such examples. It can be of particular advantage to use acidic or polyanionic inorganic carrier materials, for example of the aluminosilicate, layer silicate, or silica gel type. in this case, too, particularly firm anchorage of the soil-collecting PQUAT layer is guaranteed by the possibility of salt formation between the PQUAT coating composition and the inorganic carrier with its opposite charge.

The quaternary ammonium group in the PQUAT components used in accordance with the invention preferably contains from 1 to 3 lower alkyl radicals each containing from 1 to 6 and more especially from 1 to 3 carbon atoms. Particular importance is attributed to the quaternary ammonium group which contains from 1 to 3 alkyl radicals and, as counter-ion, residues of acids of the type normally encountered in the washing process. Examples of such a counter-ion which may be mentioned include chloride and/or sulfate, although these change to the corresponding anionic surfactant salt group in the presence of anionic surfactants, see the mentioned references German Preliminary Published Application No. 2,242,914 and SFÖW (Selfen-Fette-Öle-Wachse) 1985, p. 530. As was previously mentioned, such PQUAT/anionic surfactant salt groups can already be formed in the detergency enhancer in accordance with the invention prior to its introduction into the wash bath.

In a modified embodiment of the invention as described thus far, insoluble PQUATS and/or PQUATS immobilized on insoluble solids, in which the quaternary amonium groups characteristic of this class of compounds are at least partially replaced by nonquaternized basic amino groups, more especially by tertiary amino groups, may be used as soil-collecting detergency enhancers. This modified embodiment corresponds to the basic embodiment of the invention in all other respects. The basis for this modification is the observation underlying this embodiment of the invention that polycationic components and particularly cationic polymer compounds of the type which derive their suitability only partly, if at all, from quaternary ammonium groups, but otherwise from basic amino groups, may also be used for the purpose of the invention. The preferred non-quaternary basic amino group is the tertiary amino group. It has been found that polycationic compounds of this type are also capable of taking up suspended soil particles from the wash liquor. Polycationic tertiary amino compounds of this type may also be used by themselves as at least substantially insoluble solids or as basically soluble or swellable components which in turn are immobilized on, i.e. fixed to, sufficiently insoluble carrier materials. The content of quaternary ammonium groups here preferably amounts to at least about 5% based on the total of quaternary and nonquarternary base groups.

A typical example of polycationic compounds of the aforementioned type is the GAF "Copolymer ®937", which is a PVP/dimethylaminoethyl methacrylate copolymer having an average molecular weight of approximately 1,000,000. The use of PQUAT coatings in the narrower sense of truly polyfunctional quaternary ammonium compounds in admixture with polycationic compounds completely or partly modified in this respect falls within the scope of the invention.

The particular quantity of soil-collecting PQUAT used in the narrower or broader sense of the invention is determined by the particular determinable conditions or circumstances prevailing in each individual case. They may readily be determined by the expert through simple tests. The quantity of soil-collecting PQUAT used in a particular washing process is preferably selected in such a way that at least a substantial proportion, i.e. for example at least about 50% and preferably at least about 75% of the expected charge of suspended soil particles in the wash liquor can be taken up by the soil-collecting detergency enhancer. It may be desirable to use formulations which release such a quantity of PQUAT in the washing process that surplus capacity of the PQUAT is available for covering occasional peaks in the soil load in different washing processes. Under consideration of the high soil-collecting capacity of the detergency enhancers in accordance with the invention, the quantities of the detergency enhancer to be added to the detergent formulation are likewise low and fall, for example, below 10 g/l wash liquor, preferably below 5 g/l wash liquor, e.g., in the range of about 0.5 to 3 g/l wash liquor.

The soil uptake capacity of the soil-collecting detergency enhancers is in turn determined in particular by the quantity of functional quaternary ammonium groups or similarly acting basic amino groups, particularly tertiary amino groups which is made available in each individual case. In this case, therefore, the degree of substitution of the particular PQUAT used has to be taken into account. On the other hand, the surface of the detergency enhancer insoluble in the wash liquor is another important variable which enters into the present considerations. Naturally, therefore, it can be of advantage in accordance with the invention to use the soil-collecting detergency enhancer in forms which are distinguished by a particularly large surface area. On the one hand, it is possible to use the soil-collecting detergency enhancer in highly disperse distribution, for example, in the form of solid particles having an individual particle size of up to about 1 mm and preferably below 100μ, especially below 40μ and more preferably below about 10, as known for detergent builders based on zeolite A or for finely dispersed silicas. On the other hand, however, high surface areas are also provided by sheet-form materials of fibers or bundles of fibers. Knowing the particular characteristics of the detergency enhancers used in accordance with the invention and the expected soil load, it is readily possible to determine the minimum quantity of soil-collecting detergency enhancer required for each individual case.

The soil-collecting detergency enhancers according to the invention may be used in particular in conjunction with standard heavy-duty or even light-duty fabric detergents. It is obvious that both the carrier and the PQUAT coating selected should be able to withstand temperatures of up to about 95° C. likely to be encountered in the washing process. Suitable surfactant components include, in particular, anionic and/or nonionic surfactants. However, cationic surfactants having special properties may be employed. The usual builders and co-builders and also other typical detergent components may be used together with the surfactant components. Examples of typical detergent components include laundry alkalies, bleaches, corrosion inhibitors, optical brighteners, foam inhibitors, redeposition inhibitors, enzymes, diluents, perfumes and the like.

A detailed presentation of current customary detergent constituents may be found, for example, in *Ullmann's Enzyklopadie der technischen Chemie* (*Ullmann's Encyclopedia of industrial Chemistry*), 4th Edition, Vol. 24, pp. 81–107. In addition, detailed statements on textile detergent mixtures may be found in the aforementioned U.S. Pat. No. 3,694,364, which can also be used in the appropriate way within the framework of the present invention. In the specific detergent formulations of this document, sodium tripolyphosphate is used as the essential builder constituent; it is known today to be at least partly replaced by ecologically safer builder components, especially by the sodium zeolite NaA.

Typical basic formulas for current textile detergent mixtures correspond, for example, to the following listings:

| Active ingredient group | Example | Fraction (%) |
|---|---|---|
| GENERAL FORMULATION FOR COMPLETE DETERGENTS, WESTERN EUROPEAN TYPE (BOILABLE LAUNDRY) | | |
| anionic surfactant | alkylbenzene sulfonate | 5 to 10 |
| nonionic surfactant | fatty alcohol poly-glycol ether | 1 to 5 |
| foam inhibitors | soaps, silicone oils | 1 to 5 |
| complexing agents | Na triphosphate | 10 to 40 |
| ion exchangers | Zeolite A | 0 to 30 |
| bleaching agents | Na perborate | 15 to 35 |
| bleach activators | tetraacetyl-ethylene-diamine | 0 to 4 |
| stabilizers | ethylenediaminetetra-acetate, Mg silicate | 0.2 to 2.0 |
| graying inhibitors | carboxymethylcellulose, other cellulose ethers | 0.5 to 2.0 |
| enzymes | proteases | 0.3 to 1.0 |
| optical brighteners | stilbene-disulfonic acid-,bis-(styryl)-biphenyl-derivatives | 0.1 to 0.3 |
| corrosion inhibitors | Na silicates | 2 to 7 |
| perfumes | | 0.05 to 0.3 |
| dyes | | 0 to 0.001 |
| diluents | Na sulfate | 2 to 20 |
| GENERAL FORMULA FOR U.S. HEAVY DUTY DETERGENTS | | |
| anionic surfactants | alkylbenzene sulfonate fatty alcohol sulfate, fatty alcohol ether sulfate* | 9 to 20 |
| nonionic surfactants | alkylpolyglycol ethers | 1 to 2 |
| complexing agents | Na triphosphate, Na diphosphate | 5 to 33 |
| ion exchangers | Zeolite A | 0 to 25 |
| alkalies | Na carbonate, Na silicate | 5 to 25 |
| graying inhibitors | carboxymethylcellulose | 0 to 1 |
| enzymes | proteases | 0 to 1.5 |
| optical brighteners | stilbene-disulfonic acid-,bis-(styryl)-biphenyl-derivatives | 0.1 to 0.3 |
| perfumes | | + |
| coloring agents | | + |
| diluents | | + |
| GENERAL FORMULA FOR 60° C. DETERGENTS | | |
| anionic surfactants | alkylbenzene sulfonate | 0 to 8 |
| nonionic surfactants | alkylpolyglycol ethers | 3 to 11 |
| foam inhibitors | soaps, silicone oils | 0.1 to 3 |
| complexing agents | Na triphosphate | 20 to 40 |
| ion exchangers | Zeolite A | 0 to 30 |
| bleaching agents | Na perborate | 0 to 15 |
| stabilizers | ethylenediaminetetra-acetate | 0.1 to 0.5 |
| graying inhibitors | carboxymethylcellulose | 0.2 to 2 |
| enzymes | proteases | 0.2 to 1.0 |
| optical brighteners | stilbene-disulfonic acid-,bis-(styryl)-biphenyl-derivatives | 0.1 to 0.3 |
| corrosion inhibitors | Na silicates | 2 to 6 |
| perfumes | | + |
| diluents | Na sulfate | 5 to 20 |

GENERAL FORMULATIONS FOR SPECIAL DETERGENTS

| Component | delicate and colored laundry detergent | wool detergent | curtain detergent | hand washing detergent |
|---|---|---|---|---|
| | Fraction (%) | | | |
| anionic surfactants (alkylbenzene sulfonate, fatty alcohol-EO sulfate) | 5 to 15 | 0 to 15 | 0 to 10 | 12 to 25 |
| nonionic surfactant (fatty alcohol poly-glycol ether) | 1 to 5 | 2 to 25* | 2 to 7 | 1 to 4 |
| soap | 1 to 5 | 0 to 5 | 1 to 4 | 0 to 3 |
| cationic surfactant (dialkyl-dimethyl-ammonium chloride) | — | 0 to 5** | — | — |
| Na triphosphate | 25 to 40 | 25 to 35 | 25 to 40 | 25 to 35 |
| Na perborate | — | — | 0 to 12 | — |
| Na silicate | 2 to 7 | 2 to 7 | 3 to 7 | 3 to 9 |
| graying inhibitors | 0.5 to 1.5 | 0.5 to 1.5 | 0.5 to 1.5 | 0.5 to 1.5 |
| enzymes | 0 to 0.4 | — | — | 0.2 to 0.5 |
| optical brighteners | 0 to 0.2 | — | 0.1 to 0.2 | 0 to 0.1 |
| perfumes | + | + | + | + |
| diluents | + | + | + | + |

*higher nonionic surfactant contents only in the case of liquid products
**cationic surfactants only in the case of wool liquid detergents

GENERAL FORMULAS OF LIQUID DETERGENTS (60° C.)

| Constituent | Wool detergent with scrooping | Wool detergent without scrooping | Curtain detergents |
|---|---|---|---|
| | Fraction (%) | | |
| anionic surfactants (alkylbenzenesulfonate, fatty alcohol-EO sulfates) | — | 10 to 30 | 0 to 8 |
| nonionic surfactants (fatty alcohol poly- | 20 to 30 | 2 to 5 | 15 to 30 |

-continued

| | | | |
|---|---|---|---|
| glycol ether, fatty acid amides) | | | |
| cationic surfactants (dialkyl-dimethyl-ammonium chloride) | 1 to 5 | — | 15 to 30 |
| ethanol, propylene glycol | 0 to 10 | 0 to 10 | 0 to 10 |
| toluene, xylene or cumene sulfonate | — | 0 to 3 | — |
| builder (K—diphosphate, N—citrate) | — | 0 to 15 | 2 to 5 |
| optical brighteners perfumes, coloring agents, water, etc. | 60 to 70 | 60 to 80 | 65 to 75 |

GENERAL FORMULATIONS FOR U.S. LIQUID HEAVY DUTY DETERGENTS (60° C.)

| Constituent | Without builder Fraction (%) | With builder |
|---|---|---|
| ANIONIC SURFACTANTS (alkylbenzenesulfonate, fatty alcohol-EO sulfates) | 7 to 2 | 0 to 30 |
| nonionic surfactants (fatty alcohol polyglycol ether, fatty acid amides) | 10 to 35 | 0 to 10 |
| ethanol, propylene glycol | 3 to 22 | — |
| toluene, xylene sulfonate | — | 0 to 7 |
| builders (K diphosphate, Na citrate, Na metasilicate) | | 8 to 18 |
| optical brighteners, perfume | 30 to 65 | 50 to 60 |

The invention will now be more clearly understood by reference to the following examples which are set forth as being merely illustrative of the invention and which are not intended, in any manner, to be limitative thereof. Unless otherwise indicated, all parts and percentages are by weight. In the examples, the determination of the laundering power of the detergent formulations is conducted on known artificially soiled test fabrics selected on the basis of different fibers and soils customarily used today in the testing and development of detergent formulations, some of which are commercially available or are produced by the detergent industry according to their own standard. Known manufacturers of corresponding commercial, artificially soiled test fabrics are EMPA, Eidgenossische Materialprufungs- und Versuchsanstalt, Unterstrasse 11, CH-9001 St. Gallen, (Switzerland); Wascherei-Forschung Drefeld, WFK-Test-gewebe-GmbH, Adlerstrasse 44, D-4150 Krefeld (Federal Republic of Germany); Testfabric Inc., 200 Blackford Ave., Middlesex, N.J. USA.

Unless otherwise expressly stated, the laundering experiments for determining the primary detergency ability were performed with soiled standard test fabric swatches, polyester/cotton-based, finished, soiled with pigments and sebum (H-SH-PBV). The degree of soiling of the untreated starting material and the washed fabric samples is determined by measuring the degree of reflectance with an Elrephomat DSC 5 (Carl Zeiss, Oberkochen, FRG). The degree of soiling of the PBV test tissue used in this way amounts to 30.0 (% reflectance).

The laundering experiments are performed in the Launderometer. The respective working conditions are stated in connection with the particular examples.

EXAMPLE I

Various laundering experiments were performed with the addition of 2 insoluble cellulose powders (average particle size 50 m) quaternized to different degrees. The mean degree of substitution (MS) of the first cellulose powder (C-1) is about 0.05, and the corresponding MS of the second cellulose powder (C-2) amounts to 0.03. The quaternized cellulose powders C-1 and C-2 were produced in the known way be reacting the undissolved cellulose powder in aqueous-alkaline suspension with 3-chloro-2-hydroxypropyltrimethylammonium chloride (Quab).

In a first series of experiments, the effect on the laundering power of the aqueous wash bath of a commercial detergent brand upon addition of the test substances C-1 and C-2 to the test bath was investigated. Specifically, the following conditions were used for the laundering experiments:

Launderometer: Laundering temperature 60° C., water hardness 16° dH, bath ratio 1:30, 10 steel balls, H-SH-PBV test fabric, 30 min. laundering, 4×30 sec. rinsing.

Dosage of the commercial laundering agent: 3 g/l

Dosage of the test substances: 1 g/l.

In each experiment, 6 test swatches were used in the Launderometer pot. The number of soiled test fabric swatches is increased stepwise from 1 to 6, and correspondingly, the number of simultaneously used, non-soiled filling swatches is reduced from 5 to 0.

The laundering results obtained are summarized in Table 1 below.

TABLE 1

| % Reflectance | Without additive | C-1 | C-2 |
|---|---|---|---|
| 1 H-SH-PBV/5 filling swatches | 45.9 | 53.6 | 57.1 |
| 2 H-SH-PBV/4 filling swatches | 41.5 | 51.7 | 53.2 |
| 3 H-SH-PBV/3 filling swatches | 40.0 | 50.1 | 49.6 |
| 4 H-SH-PBV/2 filling swatches | 38.8 | 47.7 | 46.5 |
| 5 H-SH-PBV/1 filling swatches | 36.6 | 45.3 | 43.2 |
| 6 H-SH-PBV/0 filling swatches | 36.1 | 43.3 | 42.4 |

The simultaneous use of the PQUATs C-1 and C-2 under the conditions employed always resulted in a significant increase in the reflectance values.

EXAMPLE II

In a second series of experiments the laundering experiments were repeated with and without the addition of the quaternized test products C-1 and C-2; at the same time a third quaternized insoluble starch with an MS of 0.1 (C-3) is introduced into the experiment series.

The process conditions of the laundering process were the same as those of Example I, but in this case the washing process was extended to a total duration of 120 min. Specifically, the following conditions were used:

Launderometer: Laundering temperature 60° C., water hardness 16° dH, bath ratio 1:30, 10 steel balls, H-SH-PBV fabric, washing 120 min. rinsing 4×30 sec.

Dosage of the conventional detergent: 3 g/l.

Dosage of the test substance: 1 g/l.

Increasing soil loading of 1 to 6 soiled test swatches with simultaneous corresponding reduction of the filling swatches also supplied.

The laundering results are shown in Table 2 below.

TABLE 2

| % Reflectance | Without additive | C-3 | C-1 | C-2 |
|---|---|---|---|---|
| 1 H-SH-PBV/5 filling swatches | 43.4 | 45.5 | 59.7 | 57.3 |
| 2 H-SH-PBV/4 filling swatches | 38.1 | 44.0 | 53.7 | 51.3 |
| 3 H-SH-PBV/3 filling swatches | 35.7 | 41.7 | 49.7 | 45.3 |

TABLE 2-continued

| % Reflectance | Without additive | C-3 | C-1 | C-2 |
|---|---|---|---|---|
| 4 H-SH-PBV/2 filling swatches | 34.9 | 40.6 | 47.6 | 42.2 |
| 5 H-SH-PBV/1 filling swatches | 34.8 | 39.6 | 44.6 | 42.2 |
| 6 H-SH-PBV/0 filling swatches | 34.8 | 39.1 | 42.9 | 42.0 |

Here also, in all cases a significant increase in the reflectance values was found with the simultaneous use of the quaternized test substances in accordance with the invention.

EXAMPLE III

Using the quaternized cellulose powders C-1 (mean degree of substitution 0.05) and C-3 (mean degree of substitution 0.1) of Examples I and II, laundering experiments were performed with increasing soil loading at 30° C. In a first experimental series a washing time of 30 min. was maintained. In a second experimental series, to test the long-term behavior of the PQUAT additives in accordance with the invention, washing was performed with a time span prolonged to 4 hours per the washing process.

The individually utilized process conditions and the laundering results thus obtained, determined as % reflectance, are summarized in the following.

(a) Duration of the Laundering Process—30 Minutes

A series of laundering experiments was performed in the Launderometer, which with stepwise increase of soil loading first provided a commercial complete textile detergent without the addition of PQUAT compounds and then, upon simultaneous addition of the commercial complete textile detergent, provided for the addition of the chemically modified cellulose powders in accordance with the invention.

Specifically, the following process conditions were used for the laundering experiments:

Laundering temperature 30° C., water hardness 16° dH, bath ratio 1:20, 10 steel balls, H-SH-PBV fabric as soiled test material, washing 30 min., rinsing 4×30 sec.

Addition: 3 g/l commercial complete textile detergent, or 3 g/l complete textile detergent with the addition of 1 g/l PQUAT component in each case.

TABLE 3

| % Reflectance: experimental set-up | Without | C-1** | C-3*** additive* |
|---|---|---|---|
| 1 H-SH-PBV/5 filling swatches | 47.5 | 57.9 | 46.3 |
| 2 H-SH-PBV/4 filling swatches | 42.7 | 49.4 | 51.7 |
| 3 H-SH-PBV/3 filling swatches | 41.9 | 46.6 | 48.3 |
| 4 H-SH-PBV/2 filling swatches | 38.9 | 45.5 | 45.2 |
| 5 H-SH-PBV/1 filling swatches | 35.3 | 42.4 | 43.6 |
| 6 H-SH-PBV/0 filling swatches | 35.3 | 41.3 | 42.5 |

appearance of the baths:
*light gray to dark gray, cloudy, precipitate (color becomes darker with increasing soil loading).
**light gray to dark gray, cloudy, precipitate (color becomes darker with increasing soil loading).
***light gray to dark gray, turbidity settles after about 1 hour to form a blue-shimmering gray precipitate. The supernatant bath is now only slightly colored (color becomes darker with increasing soil loading).

(b) Comparison Experiments with Prolonged Washing Time

Under the same working conditions of the experiments conducted in (a) above, laundering experiments were performed with a washing time of 4 hr in each case. The experimental results obtained are summarized below.

| % Reflectance: experimental set-up | Without additive* | C-1** | C-3*** |
|---|---|---|---|
| 1 H-SH-PBV/4 filling swatches | 46.5 | 66.2 | 57.3 |
| 2 H-SH-PBV/3 filling swatches | 42.3 | 58.1 | 54.1 |
| 3 H-SH-PBV/2 filling swatches | 40.3 | 53.1 | 52.9 |
| 4 H-SH-PBV/1 filling swatches | 39.4 | 51.3 | 51.5 |
| 5 H-SH-PBV/0 filling swatches | 38.7 | 48.8 | 50.7 |

appearance of the baths:
*delicate gray to light gray, scarcely any precipitate, highly colored (color scarcely becomes more intense).
**gray to dark gray, distinct gray precipitate, highly cloudy. Color becomes more intense from (1) to (5).
***light gray to dark gray; thick gray, bluish-shimmering precipitate which settles after about ½ hr, supernatant bath only slightly cloudy (coloring becomes more intense).

EXAMPLE IV

Once again comparitive laundering experiments were performed. Here, however, as the PQUAT component in accordance with this invention, finely-divided mineral materials were used, enveloped with insolubilized PQUAT components.

In a first experimental series, as the mineral carrier, purified swellable layered silicates of the montmorillonite group were used, as sold under the registered tradename of "Dis-Thix-Extra". In a second experimental series, NaA zeolite, detergent grade, were used as the mineral carrier.

In comparative laundering studies, laundering was first performed with a commercial complete textile detergent used alone, then with addition of the uncoated mineral carrier materials to these aqueous wash baths. Finally, under the same experimental conditions, in each case the PQUAT-coated mineral materials of the indicated type were simultaneously used, identified as follows:

PQUAT: Quaternized polysaccharide of the galactomannan type with an average degree of substitution of about 0.05.

Weight ratio of mineral carrier to PQUAT component used was 10:1 or 20:1.

Simultaneous use of a surfactant of the FAES type (commercial product "Texapon N 25"/28% active ingredient $C_{12-14}$-fatty alcohol-2EO sulfate, Na salt).

In one experiment in each case, a preservative (commercial product "Bronidox") was used in the covering of the mineral carrier substance.

The composition of the PQUAT component simultaneously used in accordance with the invention is shown in Table 5 below. Here the PQUAT additives on the basis of swellable layered silicate are designated as DTE 1 to 3, and the corresponding additives on the basis of NaA zeolite are designated as SAS 1 to 3.

Laundering experiments were performed under the following experimental conditions:

TABLE 5

| Weight ratio mineral/PQUAT | Weight ratio mineral/PQUAT:FAES (28%) |
|---|---|
| DTE-1 10:1 | 1:5 |
| DTE-2 20:1 | 1:5 |

TABLE 5-continued

| Weight ratio mineral/PQUAT | Weight ratio mineral/PQUAT:FAES (28%) |
|---|---|
| DTE-3 20:1 | 1:5 + 0.2% preservative |
| SAS-1 10:1 | 1:5 |
| SAS-2 20:1 | 1:5 |
| SAS-3 20:1 | 1:5 ° 0.2% preservative |

TABLE 6

| % Reflectance | Without additives | DTE | DTE-1 | DTE-2 | DTE-3 | SAS | SAS-1 | SAS-2 | SAS-3 |
|---|---|---|---|---|---|---|---|---|---|
| 5 g complete detergent/l + 0.5 g test product/l | 77.9 gray residue | 74.0 dark gray residue | 78.6 gray residue | 81.9 gray residue | 81.3 dark gray residue | 78.2 gray residue | 79.8 gray residue | 80.6 gray residue | 80.3 gray residue |
| 5 g complete detergent/l + 2.5 g test product/l | 77.9 gray residue | 73.5 thick dark gray residue | 81.9 thick dark gray residue | 82.2 gray residue | 82.2 thick gray residue | 78.6 gray residue | 80.3 dark gray residue | 81.0 dark gray residue | 80.4 gray residue |

Launderometer, washing temperature 60° C. water hardness 16° dh, bath ratio 1:30, 10 steel balls, 30 min. washing, 4×30 sec. rinsing.

Once again, mixed fabric soiled with dust/sebum (H-SH-PBV) was used as the soiled test fabric.

Addition:

1. 5 g/l of a commercial complete textile detergent.
2. Addition of 0.5 or 2.5 g/l of uncoated mineral carrier base to 1.
3. Addition of 0.5 or 2.5 g/l of the PQUAT coated mineral carrier substances DTE-1 to 3 and SAS-1 to 3.

The laundering results obtained in the comparative laundering experiments, determined as the % reflectance, are summarized in Table 6.

At the dosage of 5 g/l used, the commercial complete textile detergent already gives high quality cleaning results; nevertheless addition of the PQUAT component in accordance with the invention once again provides a distinct improvement in the reflectance values. The addition of the uncoated mineral carriers does not provide corresponding improvement.

EXAMPLE V

Two finely-divided mineral mases having PQUATS as coatings (PQUAT-1 and PQUAT-2) were produced as follows:

PQUAT-1

10 g of the swellable layered silicate of the montmorillonite type ("Dis-Thix-Extra") were intensively mixed with the PQUAT compound based on a galactomannan, i.e., "Cosmedia Guar C-261", at a quantitative ratio of mineral component to PQUAT of 20:1 in the presence of 50 g of a surfactant on an FAES basis (Texapon N 25) and in the presence of 0.12 g of preservative (Bronidox), and the mixture was dried in an oven at moderately elevated temperatures. The dry product was processed into a fine powder.

PQUAT-2

In a similar manner, a second PQUAT-coated mineral material was produced, but now as the mineral carrier substance, instead of the swellable layered silicate of natural origin, a comparable synthetic layered silicate with hardly any developed swellability was used.

In comparison investigations, the cleaning-enhancing effects of an aqueous surfactant bath were determined, as obtained by addition of:

PQUAT-1 or PQUAT-2;

additional surfactant quantities introduced into the system via PQUAT-1 or PQUAT-2; or joint addition of surfactant quantities equivalent to these plus uncoated mineral carrier material.

In two additional experiments the aqueous surfactant bath was mixed with PQUAT-1 OR PQUAT-2; but in this series the FAES surfactant content in the aqueous wash bath was reduced by the amount introduced into the system via the respective PQUAT component. The systems investigated, their addition amounts and the laundering conditions used are summarized in the following.

TEST PRODUCTS AND THEIR ADDITION RATES 1. 0.5 g/l (active substance=AS) surfactant on an FAES basis (Texapon N25).
2. 0.5 g/l (AS) FAES surfactant+0.5 g/l PQUAT-1.
3. 0.5 g/l (AS) FAES surfactant+0.3 g (AS)/l FAES surfactant.
4. 0.5 g/l (AS) FAES surfactant+0.3 g (AS) FAES surfactant+0.2 g/l swellable layered silicate (Dis-Thix-Extra).
5. 0.2 g/l (AS) FAES surfactant+0.5 g/l PQUAT-1.
6. 0.5 g/l (AS) FAES surfactant+0.5 g/l PQUAT-2.
7. 0.5 g/l (AS) FAES surfactant+0.15 g/l (AS)-/FAES surfactant.
8. 0.35 g/l (AS) FAES surfactant+0.5 g/l PQUAT-2.

The laundering conditions used are as follows:

Launderometer laundering at 30° C., 60° C. and 90° C. Water hardness 16° dH, bath ratio 1:30, 10 steel balls.

TABLE 7

| Formula No. | | 1 | 2 | 3 | 4 | 5 | 6 | 7 | 8 |
|---|---|---|---|---|---|---|---|---|---|
| % reflectance | 30° C. | 41.3 | 53.3 | 48.0 | 47.3 | 46.0 | 53.1 | 45.5 | 40.8 |
| | 60° C. | 47.1 | 70.7 | 61.1 | 62.7 | 58.4 | 69.4 | 51.9 | 55.6 |
| | 90° C. | 40.6 | 74.0 | 62.1 | 61.8 | 55.0 | 70.3 | 50.8 | 43.5 |

TABLE 8

| | | |
|---|---|---|
| without addition | 39.0 | % reflectance |
| PQUAT-3 | 43.5 | % reflectance |

TABLE 8-continued

| | | |
|---|---|---|
| PQUAT-4 | 56.8 | % reflectance |
| PQUAT-5 | 44.9 | % reflectance |
| PQUAT-6 | 43.4 | % reflectance |
| PQUAT-7 | 44.7 | % reflectance |

Soiled test fabric H-Sh-PBV, 30 min. washing, 4×30 sec. rinsing.

The laundering results, given as % reflectance, are summarized in Table 7, which follows.

EXAMPLE VI

Swellable layered silicates on a montmorillonite basis ("Dis-Thix-Extra") were covered with various synthetic PQUAT components in a DTE:PQUAT quantitative ratio of 20:1. In the manner indicated according to Example IV, testing was simultaneously performed by addition of the surfactant on an FAES basis. The PQUAT components obtained in this way are identified as follows:

| Type designation | Polymer compound used |
|---|---|
| PQUAT-3 | Merquat ® 100 |
| PQUAT-4 | Binaquat ® |
| PQUAT-5 | Cellquat ® |
| PQUAT-6 | IR-400 ® |
| PQUAT-7 | Mirapol ® A 15 |

Using these cleaning-enhancing PQUAT components, laundering experiments were performed in a wash bath containing 0.5 g (AS)/l FAES surfactant, wherein on one hand the laundering performance of the pure surfactant bath was determined, and then the testing was performed in each case with the addition of 0.5 g/l of the PQUAT component designated.

The laundering results obtained, determined as the % reflectance brightening value, are summarized in Table 8.

EXAMPLE VII

Unfinished cotton swatches were saturated with the following active ingredient formula and then dried by storing at room temperature for 2 days: 0.5 wt-% "Cosmedia Guar C 261", 53.6 wt-% "Texapon N 25" (28% AS), 0.2 wt-% preservative, 45.7 wt-% water.

In a wash bath containing 3 g/l of a commercial complete detergent, laundering experiments were performed under the following conditions:

Launderometer laundering, laundering temperature 60° C., water hardness 16° dH, bath ratio 1:30, 10 steel balls, H-HS-PBV fabric, washing time 30 min., rinsing 4× 30 sec.

The laundering result of the surfactant bath without simultaneous use of the PQUAT-coated cotton fabric (2 soiled swatches, 2 filling swatches), determined as % reflectance, amounts to a numerical value of 59.7.

If the 2 filling swatches are replaced by corresponding PQUAT-coated swatches in accordance with the invention, the slightly reduced reflectance value of 57.3 is obtained under the same laundering conditions.

In an additional experiment, first the PQUAT-coated cotton swatches as such were subjected to laundering under the indicated standard conditions. The coated cotton swatches removed from this wash cycle and freed from soluble PQUAT fractions were washed with the test fabric in an additional laundering experiment under the indicated standard conditions. The laundering result now obtained shows the clearly increased % reflectance value of 66.4. The significance of the process condition required in accordance with the invention, that the PQUAT compounds as such are also insoluble under the temperature loadings of the laundering condition and/or immobilized on corresponding insoluble solids in such a way that they cannot be washed off in these aqueous surfactant baths, becomes clear from these comparative laundering experiments.

We claim:

1. A soil-collecting detergency enhancer comprising a substantially water-insoluble polyfunctional quaternary ammonium compound or a water-soluble polyfunctional quaternary ammonium compound fixed to a water-insoluble solid carrier, said carrier comprising a particulate, finely-divided material having an average particle size of up to about 1 mm.

2. A fabric detergent composition comprising conventional builders, surfactants and customary laundering aids, and a polyfunctional quaternary ammonium compound which is at least substantially insoluble in an aqueous detergent solution and/or is fixed to an insoluble solid as a soil-collecting detergency enhancer, said solid comprising a particulate, finely-divided material having an average particle size of up to about 1 mm.

3. A process for removing particulate soil from a fabric wash solution containing soil particles and enhancing the detergency of said wash solution comprising contacting said wash solution with a polyfunctional quaternary ammonium compound which is at least substantially insoluble in said solution and or is fixed to a solid correspondingly insoluble in said solution, as a soil-collecting detergency enhancer in said solution and which may be manually and/or mechanically separated from the fabric washed in said solution, said solid comprising a particulate, finely-divided material having an average particle size of up to about 1 mm.

4. A process in accordance with claim 3 wherein said polyfunctional quaternary ammonium compound comprises an oligomeric and/or polymeric polyfunctional quaternary ammonium compound having an average molecular weight of at least about 300.

5. A process in accordance with claim 4 wherein said polyfunctional quaternary ammonium compound has an average molecular weight of from about 1,000 to about 10,000,000.

6. A process in accordance with claim 3 wherein said soil-collecting detergency enhancer is in the form of a solid, particulate, finely-divided carrier to the surface of which is fixed said polyfunctional quaternary ammonium compound.

7. A process in accordance with claim 3 wherein said soil-collecting detergency enhancer contains a water-soluble and/or water-swellable polyfunctional quaternary ammonium compound chemically and/or physically attached to the surface of said solid.

8. A process in accordance with claim 3 wherein said soil-collecting detergency enhancer has attached to it an anionic group.

9. A process in accordance with claim 8 wherein said soil-collecting detergency enhancer has attached to it an anionic group in the form of a salt.

10. A process in accordance with claim 3 wherein said polyfunctional quaternary ammonium compound has been applied to a particulate, finely-divided inorganic or organic solid which is insoluble or substantially insoluble in said solution and wherein an anionic group is attached to at least part of said polyfunctional quaternary ammonium compound to form a salt thereof.

11. A process in accordance with claim 3 wherein said solid comprises a natural and/or synthetic water-insoluble mineral selected from the group consisting of aluminosilicate, layered silicate, and silica.

12. a process in accordance with claim 11 wherein said aluminosilicate comprises a synthetic, crystalline zeolite selected from the group consisting of zeolite A, zeolite X, and zeolite P.

13. A process in accordance with claim 3 wherein said solid comprises a substantially water-insoluble, finely-divided metal oxide and/or hydroxide and metal salt thereof.

14. A process in accordance with claim 3 wherein said polyfunctional quaternary ammonium compound comprises a polygalactomannan derivative.

15. A process in accordance with claim 14 wherein said polygalactomannan derivative comprises guar hydroxypropyl trimethylammonium chloride containing a cationic group corresponding to the formula $$CH_2CH(OH)CH_2N^{(+)}(CH_3)_3Cl^{(-)}$$

attached to the oxygen atom of the hydroxyl group of the polysaccharide.

16. A process in accordance with claim 3 wherein said polyfunctional quaternary ammonium compound contains a quaternary ammonium group which is at least partially replaced by a non-quaternized basic amino group.

17. A process in accordance with claim 3 wherein said wash solution contains a surfactant selected from the group consisting of an anionic surfactant or a non-ionic surfactant.

18. A process in accordance with claim 3 wherein said wash solution has a temperature of up to about 95° C.

19. A process for removing particulate soil from an aqueous detergent solution containing soil particles thereby enhancing the detergency of said detergent solution comprising contacting said detergent solution with a polyfunctional quaternary ammonium compound that is water-soluble and/or water-swellable and has been fixed to a water-insoluble carrier as a soil-collecting detergency enhancer in said aqueous detergent solution and which may be manually and/or mechanically separated from articles washed in said detergent solution, said carrier comprising a particulate, finely-divided material having an average particle size of up to about 1 mm.

20. A process in accordance with claim 19 wherein said polyfunctional quaternary ammonium compound comprises a cellulose ether wherein the anhydroglucose units therein each contain from 1 to 3 substituents containing a quaternary ammonium group attached via ether oxygen.

* * * * *